US006452094B2

(12) United States Patent
Donner et al.

(10) Patent No.: US 6,452,094 B2
(45) **Date of Patent: *Sep. 17, 2002**

(54) HIGH SPEED TRANSMISSION LOCAL AREA NETWORK CABLE

(75) Inventors: Daryle Pat Donner, Council Bluffs, IA (US); Harold Wayne Friesen, Dunwoody, GA (US); David R. Hawkins, Sugar Hill, GA (US); Robert Henry Jackson, Grayson, GA (US); Stephen Taylor Zerbs, Gretna, NE (US)

(73) Assignee: Lucent Technologies Inc., Murray Hill, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/325,178

(22) Filed: Jun. 3, 1999

(51) Int. Cl.[7] ..... H01B 11/02
(52) U.S. Cl. ..... 174/27; 174/113 R
(58) Field of Search ..... 174/113 R, 121 A, 174/27, 117 F, 33, 34; 57/204, 206

(56) References Cited

U.S. PATENT DOCUMENTS

| | | | | | |
|---|---|---|---|---|---|
| 4,381,426 | A | * | 4/1983 | Crokite et al. | 174/117 F |
| 4,697,051 | A | | 9/1987 | Beggs et al. | 178/63 D |
| 4,873,393 | A | | 10/1989 | Friesen et al. | 174/34 |
| 5,424,491 | A | | 6/1995 | Walling et al. | 174/113 R |
| 5,739,473 | A | * | 4/1998 | Zerbs | 174/121 A |
| 5,814,768 | A | | 9/1998 | Wessels et al. | 174/110 |
| 5,821,466 | A | * | 10/1998 | Clark et al. | 174/113 R |
| 5,834,697 | A | | 11/1998 | Baker et al. | 174/113 |
| 6,037,546 | A | * | 3/2000 | Mottine et al. | 174/113 R X |

* cited by examiner

*Primary Examiner*—Chau N. Nguyen

(57) ABSTRACT

A local area network cable capable of high speed signal transmission has a plurality of twisted pairs of conductors enclosed within a jacket. Each of the twisted pairs has a different twist frequency than any of the other pairs, and at least one of the pairs has a direction of twist that is different from the other twisted pairs, that is, it may have a right hand twist where the other pairs have a left hand twist. In a four pair cable, two of the pairs, of different twist frequency, have imparted thereto a right hand twist, and two of the pairs have a left hand twist.

7 Claims, 4 Drawing Sheets

HIGH SPEED TRANSMISSION LOCAL AREA NETWORK CABLE

FIELD OF THE INVENTION

This invention relates to a cable for local area network (LAN) use, and, more particularly, to a cable having relatively low crosstalk at high bit rates over relatively long distances.

BACKGROUND OF THE INVENTION

With the continuing development and use of data processing devices such as, for example, computers, and, more particularly, devices depending upon digital signals, there has developed a need for signal transmission media that provide substantially error free transmission of both analog and digital data signals at high rates. However, there are numerous factors which work against such transmission, chief among which is crosstalk. One commonly used cable configuration is a core arrangement of unshielded twisted pairs of wires contained within a cable jacket, but unless certain precautionary design modifications are included in the cable, crosstalk becomes a severe problem with increasing frequencies.

The unshielded twisted pair has always been used for telephone transmission in the balanced, or differential mode, and of late, its latent transmission capability in the unbalanced mode has come to be recognized. Especially noteworthy is the twisted pair's capability of transmitting rugged quantized digital signals as compared to analog signals. In such transmission, for example, a four pair cable, generally two of the pairs transmit signals in one direction to a computer system, for example, and two of the pairs transmit signals in the other direction, e.g., from the computer system. In any such arrangement, near end crosstalk (NEXT) can cause a serious signal degradation, especially at high bit rates with digital signals. There have been numerous schemes proposed for reducing the deleterious effects of NEXT upon the signal being transmitted. Examples of such arrangements are shown in U.S. Pat. No. 4,697,051 of Beggs et al., U.S. Pat. No. 4,873,393 of Friesen et al., and U.S. Pat. No. 5,424,491 of walling et al. In the Friesen et al. patent, the disclosure of which is incorporated herein by reference, there is shown a cable having two or more twist pairs, in which the twist frequency of each pair is different than the twist frequency of the other pair or pairs such that the increments of the twist frequency spacing between adjacent pair are non-uniform and the twist length of each pair does not exceed the product of approximately forte (40) times the diameter of an insulated conductor of each pair. The short twist length and the gathering together of the conductor pairs effectively reduces pair meshing, thus maintaining a physical separation (spacing) among the pairs that tends to reduce interaction therebetween, further reducing crosstalk. The cabling scheme also eliminated the need for shielding of the conductors.

The foregoing patents all disclose inventions directed to the reduction of NEXT, and at least part of the ability of these arrangements to reduce near end crosstalk stems from the two way, or bidirectional signal transmission which, in effect, through the electromagnetic interaction, produces at least some cancellation of NEXT.

There are systems or networks, however, in which large numbers of signal receiving and transmitting components are involved to the extent that, especially at high speeds, NEXT becomes limiting. In such cases, it is the practice to use two or more cable groups, with all of the pairs in one cable transmitting unidirectionally toward the stations or equipment of the network, and the pairs of the other cable transmitting from the stations. In this way, crosstalk isolation is achieved. With such unidirectional transmission, another form of crosstalk, commonly called far end crosstalk (FEXT) becomes a factor in the ability of the cable to deliver signals that have not been seriously or hopelessly degraded. Heretofore the cables that have been designed to reduce NEXT have demonstrated sporadic FEXT results, especially in Category 6 type cables, i.e., cables for 100 megahertz or higher signal transmission, and, in many cases, fail the test of reduced signal degradation. When it is appreciated that far end crosstalk in a unidirectional transmission arrangement is the summation of all the couplings between the twisted pairs, as opposed to the average coupling in a bidirectional system, it becomes clear that FEXT is an important factor to be considered.

SUMMARY OF THE INVENTION

The present invention is a twisted pair cable which is designed to produce FEXT performance that is consistently within acceptable limits, thereby insuring transmission of high speed (or high frequency) digital data, and is based upon the discovery that different twisted pairs within the cable produce such results where some of the pairs have opposing twists. In other words, some of the pairs have a right hand twist and some have a left hand twist. Conductor pairs with the appropriate opposed twists do not tend to physically mesh, hence, the effective transverse spacing between pairs is increased and substantially constant, thereby reducing the crosstalk, or coupling, between pairs. When these couplings are reduced, their summation is also reduced, hence FEXT is reduced.

In, for example, a cable having a core that has four pairs, A, B, C, D, there are six possible couplings, AB, AC, AD, BC, BD, and CD when the twists are all in the same direction, either right hand or left hand as in present day cables. On the other hand, if pair A is given an opposite direction twist from the other three, there are only three possible same direction couplings, BC, BD, and CD. If pairs A and B are given, for example, left hand twists and pairs C and D have right hand twists, there are only two possible same direction couplings, AB and CD. It can be appreciated that a decrease in the number of couplings is desirable in reducing FEXT.

Although the principles of the invention obtain with different numbers of twisted pairs within the cable, these principles are best illustrated with reference to four twisted pairs. Hence, in one embodiment of the invention, the cable thereof comprises four pairs of insulated wires enclosed in a tubular member of suitable plastic material. A metallic shield may or may not enclose the tubular member, and a plastic jacket preferably surrounds the assembly.

In accordance with the principles of the invention, a first twisted pair (pair A) has a left hand twist of, for example, approximately 0.380" to 0.523" twist length and a second twisted pair (pair B) has a left hand twist of, for example, approximately 0.390" to 0.487" twist length. A third twisted pair (pair C) has a right hand twist of, for example, approximately 0.580" to 0.619" twist length and the fourth twisted pair (pair D) has a right hand twist of, for example, 0.650" to 0.713" twist length. In a preferred embodiment, pairs A, B, C, D have values of approximately 0440", 0.410", 0.596", and 0.670", respectively. Thus, all of the twist lengths are both short and different, and separation among pairs is maintained, thereby reducing the meshing which produces a consequent enhanced coupling. It has been found that such a cable arrangement does not materially affect NEXT performance, although it does not, apparently, improve it, but that it does result in improved FEXT performance.

The cable of the invention also produces a physical as well as an electrical benefit. In present day twisted pair cables, wherein all of the twisted pairs have the same twist direction, i.e., left hand or right hand, a torsion is imparted to the cable such that in relatively long lengths of cable, the cable itself becomes difficult to manipulate during installation. The cable of the invention, on the other hand, is more mechanically or physically neutral inasmuch as there is less creation of torsion with the different pairs having different directions of twist.

The numerous principles and advantages of the present invention will be more readily apparent from the following detailed description, read in conjunction with the accompanying drawings.

DETAILED DESCRIPTION

Figure 1:
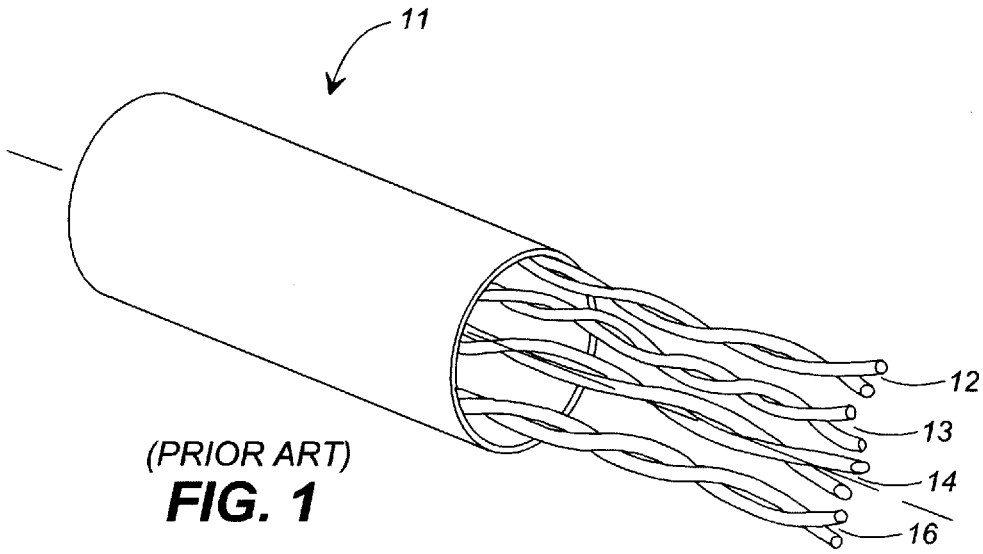
(PRIOR ART) FIG. 1
FIG. 1 is a section of cable showing pairs twisted for NEXT improvement, as used in the prior art.

In FIG. 1 there is shown a short section of cable 11 having therein four pairs of twisted insulated metallic conductors 12, 13, 14, and 16, as used in the art for the reduction of NEXT. As can be seen, each of the twisted pairs has a different twist frequency (twists per inch) and all pairs are twisted in the same direction, which, in FIG. 1, is shown as a left-hand (LH) twist. It is to be understood that cable 11 may have considerably more than four pairs of conductors, and that the twist, which is the same direction for all pairs, may be different, i.e.,(different twist frequency for each pair, giving rise to a parameter referred to as twist frequency difference (TFD). In addition, it is often customary to group the several pairs in a bundle, and then to impart a twist in the same direction to the bundle, giving rise to another parameter, stranding lay, i.e., SL which has the effect of tightening the twists of the conductor pairs. It is also possible to have the stranding in an opposite twist.

Figure 2A:
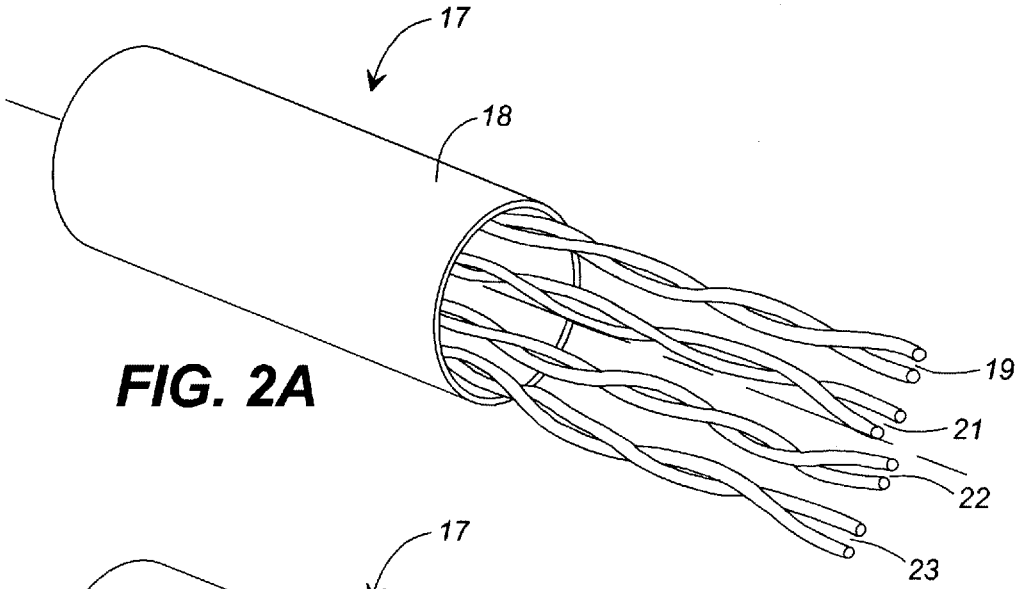
FIG. 2A is a section of cable showing pairs twisted for FEXT in accordance with the present invention.

In FIG. 2A there is shown a preferred embodiment of the present invention which comprises, in its simplest form, a cable 17 comprising a cable jacket 18 of suitable insulating material enclosing four twisted conductor pairs 19, 21, 22, and 23. It is to be understood that cable 17 may include other components such as shielding, metallic jacketing, and/or water blocking members, which, however, have not, for simplicity, been shown. In accordance with the principles of the present invention, and, as shown in FIG. 2A, pairs 19 and 22 have a left-hand (LH) twist and pairs 21 and 23 have a right-hand (RH) twist. Each pair has a different twist frequency which also may be referred to as twist length. Thus, pair 19 has a LH twist length in the range of 0.380 to 0.523 inches; pair 21 has a RH twist length in the range of 0.580 to 0.619 inches; pair 22 has a LH twist length of 0.390 to 0.487 inches; and pair 23 has a RH twist length of 0.650 to 0.713 inches. In the discussion that follows, the twist lengths of the cable for which test results are given were 0.434", 0.593", 0.400", and 0.665". It is to be understood that exact lengths are difficult to achieve and to maintain because of the physical nature of twisted metallic wires, and the values given are, for the most part, close approximations. From the values given for the test cable, the TFD can be determined for the different wire pairs.

Figure 2B:
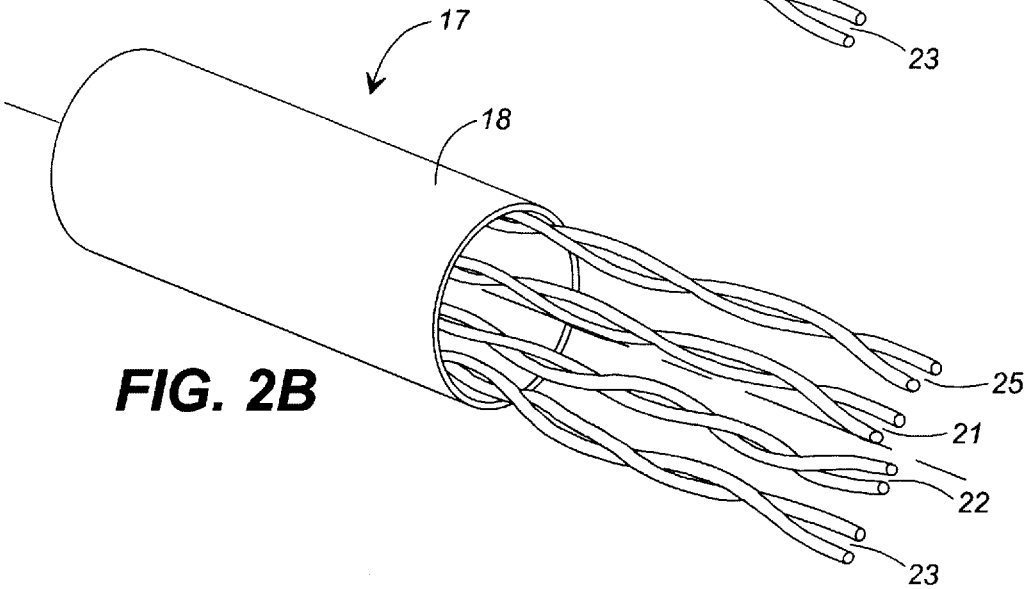
FIG. 2B is a section of cable showing pairs twisted for FEXT in accordance with the present invention.

In FIG. 2B there is shown an embodiment of the present invention which comprises, in its simplest form, a cable 17 comprising a cable jacket 18 of suitable insulating material enclosing four twisted conductor pairs 21, 22, 23 and 25. In accordance with the principles of the present invention, and, as shown in FIG. 2B, pair 22 has a left-hand (LH) twist and pairs 21, 23 and 25 have a right-hand (RH) twist.

The plots of FIGS. 3 through 8 demonstrate the efficacy and the soundness of the principles of the present invention.

All of the prototype cables used in making the measurements were four pair cables, having pair twists of approximately 0.434, 0.400, 0.593, and 0.665 inches. The designs centered around using right-hand twists on one or more pairs where the normal twist direction was left-hand. Some of the prototypes had only one pair of opposite twist direction causing three of the possible six pair combinations to have opposite twists, as discussed hereinbefore. Other prototypes had two pairs of opposite twist direction, resulting in four of the six possible pair combinations having opposite twist. In some prototypes, two adjacent pairs were reversed while in others two diagonal pairs were reversed. The control cable had all pairs twisted left, as shown in FIG. 1. A second set of cables was also used so as to populate voids in the experimental domain. The twist lengths for these cables were 0.351, 0.495, 0.685, and 0.969 inches. In the plots, the zero datum line is the industry standard at a specified frequency for acceptable crosstalk. Thus, any positive going measurements represent improved crosstalk while negative going measurements represent increased crosstalk. All cables used in the measurements were approximately 100 meters in length. The plots all rely upon the commonly used twist frequency difference (TFD) parameter, where twist frequency is given by the number of twists per unit of lengths (e.g., inches), where small values result for pairs twisted in the same direction. Opposite twists show up with TFDs in the 2 to 5 twists/inch ranges while conventional same direction twists appear in the 0 to 2 twists/inch range.

Figure 3:
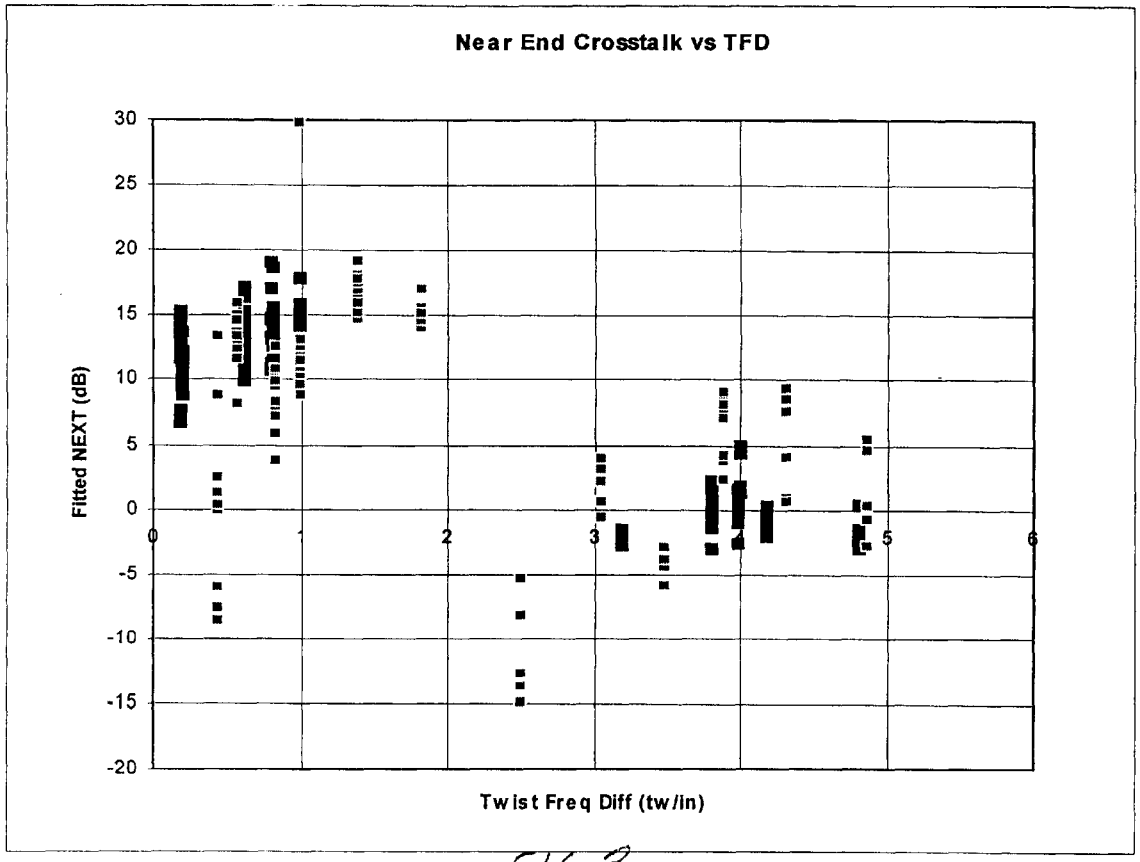
FIG. 3 is a plot of measured NEXT versus TFD for both the cable of FIG. 1 and the cable of FIG. 2A.

The plot in FIG. 3 with prior art cable on the left and cable of the invention on the right demonstrates that opposite direction twist pair combinations have inferior NEXT performance to those of the same twist direction, the average being approximately 12 db less. Of interest is the fact that both same and opposite twists show improvement with increasing twist frequency difference.

Figure 4:
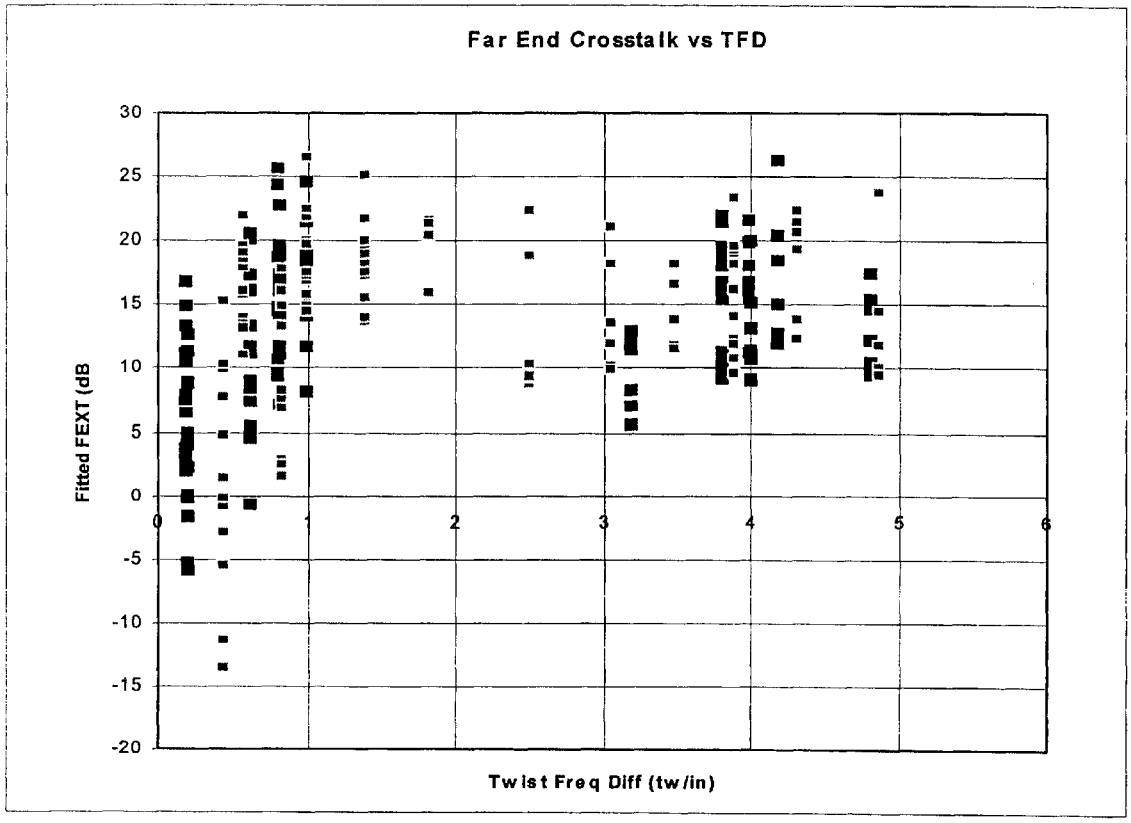
FIG. 4 is a plot of measured FEXT versus TFD for the cables of FIGS. 1 and 2A.

The plot in FIG. 4 shows that to opposite twist (2 to 5 twists/inch range) results in better FEXT performance than the same direction twists, by an average of about 15 db, and shows considerably less variation. It can also be seen that, for the same direction of twist, small values of TFD have considerably more variation. Thus, for better FEXT performance, the cable of FIG. 2A, embodying the principles of the invention, is the preferred configuration by a considerable, heretofore unrealized margin.

Figure 5:
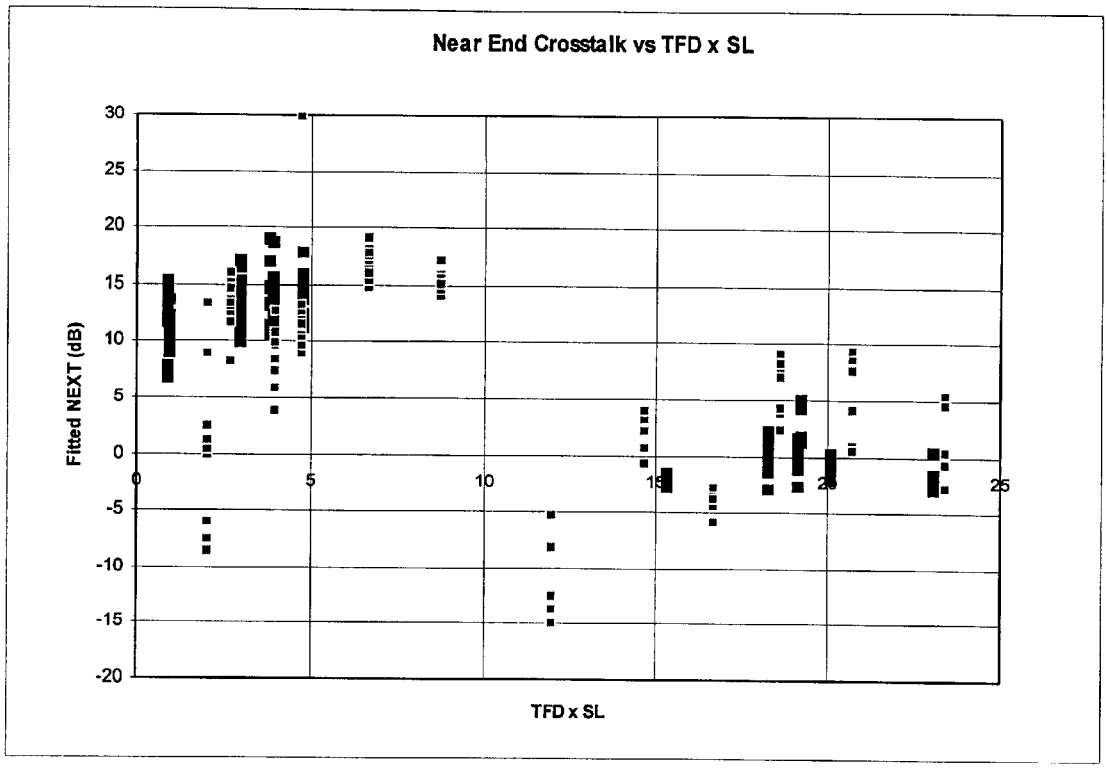
FIG. 5 is a plot of measured NEXT versus TFD times the stranding lay SL for the cables of FIGS. 1 and 2A.

Interaction between TFD and the stranding lay has been observed in the prior art, and it has been found that the product of TFD×SL should not be an integer, or, more specifically, within±0.1 of an integer. While this caveat has been based on NEXT results, it applies to FEXT performance also. In FIG. 5, the abscissa values are TFD×SL for NEXT measurements, and it can be seen that same twist direction pairs produce superior results as opposed to different direction twists, and that both show inferior performance at abscissa integer values 2 and 12 (TFD×SL).

Figure 6:
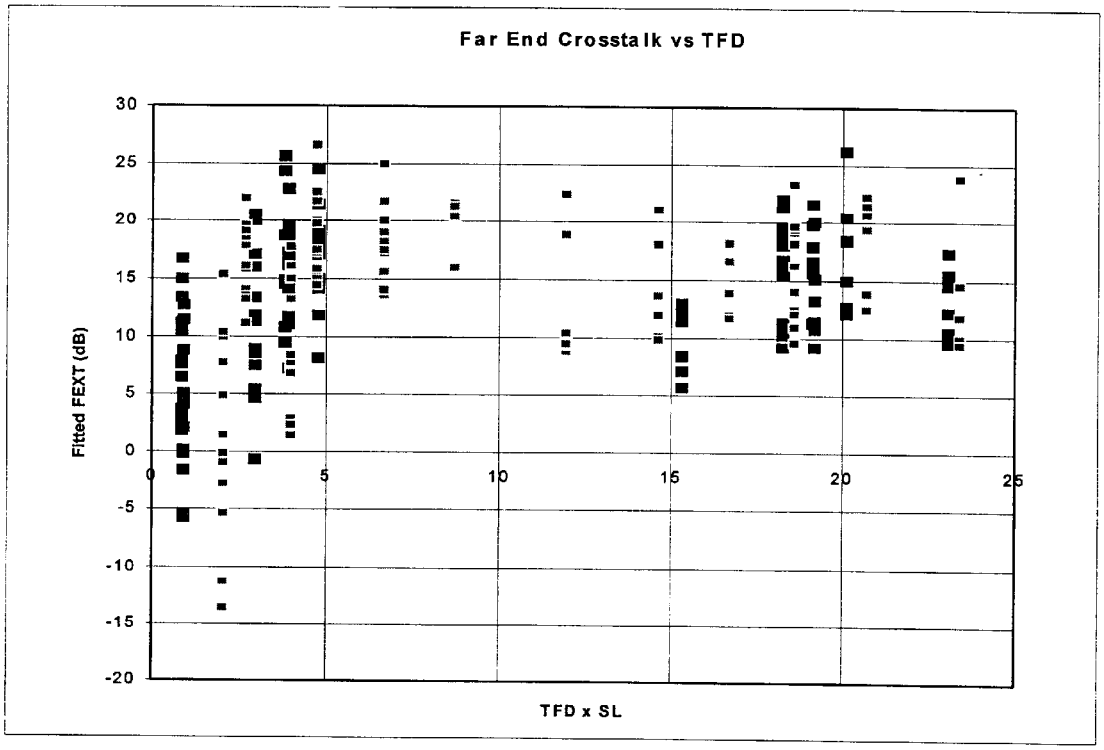
FIG. 6 is a plot of measured FEXT versus TTD times SL for the cables of FIGS. 1 and 2A.

FIG. 6 is a plot of FEXT results for values of TFD×SL and demonstrates that FEXT performance for opposite twist directions is considerably superior, by an average of approximately 15 db over the same twist case, and even where TFD×SL is close to an integer, performance is less degraded.

Figure 7:
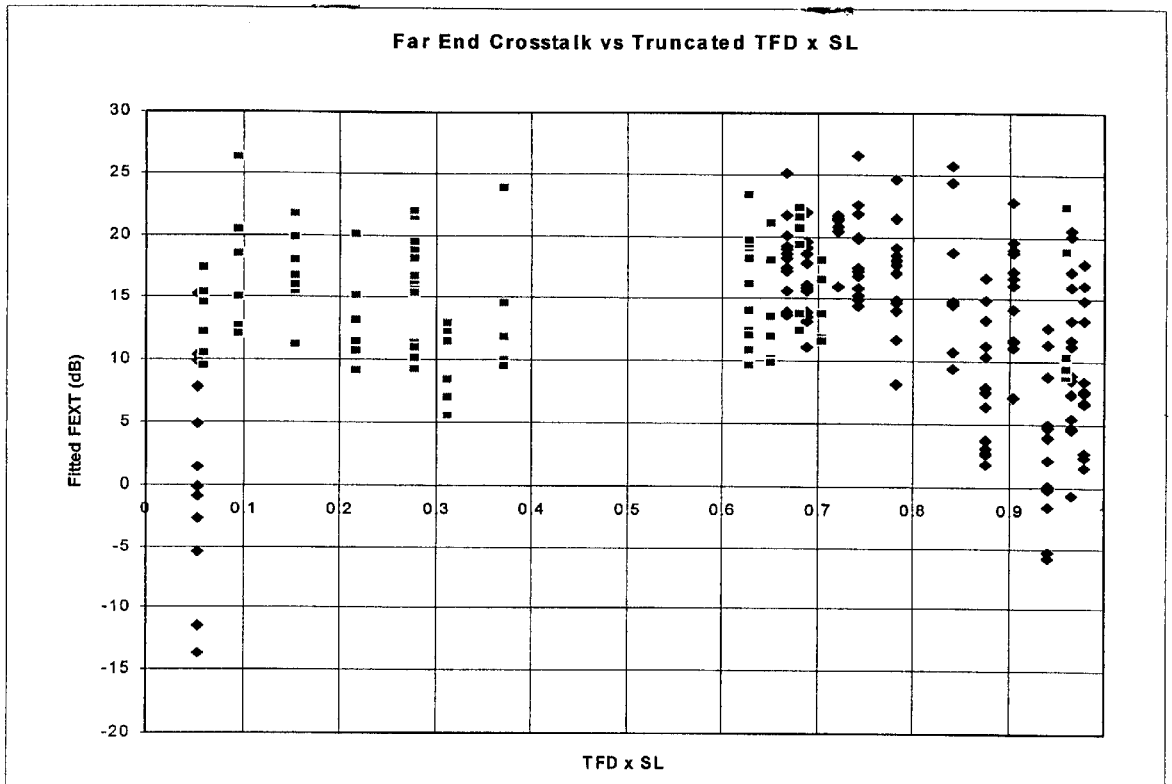
FIG. 7 is a plot of measured FEXT versus truncated (0 to 1 range) TFD×SL for the cables of FIGS. 1 and 2A.

FIG. 7 is a FEXT plot which also uses TFD×SL as the abscissa, however, the values are truncated into the 0 to 1 range. As a consequence, the results for the two twist configurations are intermingled with diamonds representing same twist direction measurement and squares representing opposite twist directions. This plot demonstrates the near integer values of TFD x SL are to be avoided. The mid-range values result in FEXT the is approximately a 15 dB improvement over same twist cables, and exhibit less variation.

Figure 8:
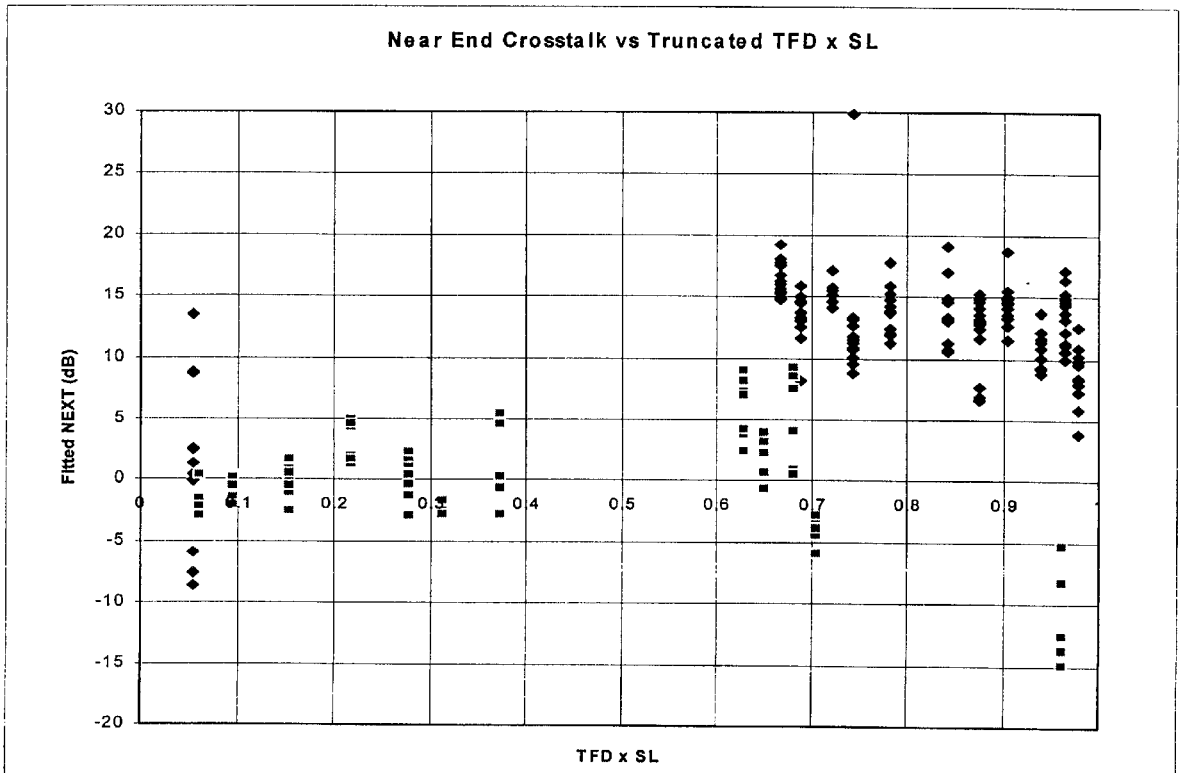
FIG. 8 is a plot of measured NEXT versus truncated (0 to 1 range) TFD×SL for the cables of FIGS. 1 and 2A.

FIG. 8 is a plot similar to that of FIG. 7, but shows NEXT performance. It can be seen, as expected, that the different twist direction arrangement is inferior to the same twist arrangement.

From the foregoing it is clear that a cable arrangement wherein at least one of the twisted pairs therein has a different direction of twist than the remaining twisted pairs gives a marked improvement in far end crosstalk. As was pointed out, where all of the pairs in the cable transmit signals in only one direction, as in ATM systems, far end crosstalk becomes a major consideration, and the present invention produces far end crosstalk results that are well within tolerable limits and that are superior to results from standard prior art cables wherein all pairs are twisted in the same direction. The different twist direction arrangement and the differences in the individual twist frequencies tend to discourage nesting of the pairs, with a concomitant reduction in interaction between pairs. The far end improvement is large enough to be a possible influence on cabling architecture of the future.

In conclusion, it should be noted that it will be obvious to those skilled in the art that many variations and modifications may be made to the preferred embodiment without substantial departure from the principles of the present invention. All such variations and modifications are intended to be included as being within the scope of the present invention as set forth in the claims. Further, in the claims, the corresponding structures, materials, acts, and equivalents of all means or step plus function elements are intended to include any structure, material, or acts for performing the functions with other claimed elements as specifically set forth.

What is claimed is:

1. A cable for high speed transmission of electrical signals, said cable being characterized by having several insulated conductors therein and having far end crosstalk (FEXT), which is characterized by additive couplings among the several conductors in the cable along the length thereof, and to near end crosstalk (NEXT), said able having a core configuration for reducing FEXT relative to NEXT by reducing the additive coupling among the several conductors, said core configuration comprising:

a plurality of twisted pairs of insulted conductors,at least one pair of which has a twist direction different from the twist direction of at least one other of said twisted pairs;

each of said twisted pairs having a twist length that is different from the twist length of the other ones of said plurality of pairs to produce twist frequency differences (TFD) among the plurality of conductor pairs, adjacent pairs of said twisted pairs of opposite twist having a twist frequency difference (TFD) of 2 to 5; and a jacket surrounding said core and enclosing the twisted pairs of conductors.

2. A cable as claimed in claim 1 wherein said plurality of twisted pairs comprises at least four twisted pairs of conductors, and one said twisted pairs has a twist direction different from the other three pairs.

3. A cable as claimed in claim 1 wherein said plurality of twisted pairs comprises at least four twisted pairs of conductors and two said twisted pairs has a twist direction different from the other two pairs.

4. A cable for high speed transmission of electrical signals, said cable being characterized by having several insulated conductors therein and having near end crosstalk (NEXT) and far end crosstalk (FEXT), which is characterized by additive couplings among the several conductors in the cable, said able having a core configuration for reducing FEXT relative to NEXT, said core configuration comprising:

at least four twisted pairs of insulated conductors, the twist length of a first pair being in the range of approximately 0.380" to 0.523";

the twist length of a second pair being in the range of approximately 0.39" to 0.487";

the twist length of a third pair being in the range of approximately 0.580" to 0.619"; and the twist length of a forth pair being in the range of approximately 0.650" to 0.713";

at least one pair of which has a twist direction different from the twist direction of at least one other of said twisted pairs;

each of said pairs having a twist length that is different from the twist length of the other ones of said pairs sufficient to reduce the additive FEXT coupling among the several insulated conductors; and a jacket surrounding said core and enclosing the twisted pairs of conductors.

5. A cable as claimed in claim 4 wherein the twist length of said first pair is approximately 0.440";

the twist length of said second pair is approximately 0.410";

the twist length of said third pair is approximately 0.596"; and the twist length of said fourth pair is approximately 0.670".

6. A cable as claimed in claim 4 wherein said core including all of said twisted pairs has a twist imparted thereto which is measured by a parameter known as stranding lay.

7. A cable as claimed in claim 6 wherein the product of the twist frequency difference among pairs of twisted pairs times the stranding lay is not an integer value.

* * * * *